United States Patent [19]

Pinson

[11] Patent Number: 4,580,113

[45] Date of Patent: Apr. 1, 1986

[54] ELECTRICALLY CONTROLLED RADIO FREQUENCY ATTENUATOR

[75] Inventor: George T. Pinson, Huntsville, Ala.

[73] Assignee: The Boeing Company, Seattle, Wash.

[21] Appl. No.: 600,994

[22] Filed: Apr. 16, 1984

[51] Int. Cl.[4] ..... H01P 1/23

[52] U.S. Cl. ..... 333/81 B; 333/24.1; 333/24.2

[58] Field of Search ..... 333/24.1, 24.2, 81 B

[56] References Cited

U.S. PATENT DOCUMENTS

| | | | |
|---|---|---|---|
| 2,532,157 | 11/1950 | Evans | 333/81 B X |
| 2,629,079 | 2/1953 | Miller et al. | 333/81 B X |
| 2,944,220 | 7/1960 | Tellegen | 333/24.1 X |
| 2,983,883 | 5/1961 | Luhrs | 333/81 B X |

*Primary Examiner*—Paul Gensler

*Attorney, Agent, or Firm*—Edwin H. Crabtree

[57] ABSTRACT

An electrically controlled radio frequency attenuator for electrically and magnetically controlling the attenuation transmitted power in a waveguide.

2 Claims, 3 Drawing Figures

ELECTRICALLY CONTROLLED RADIO FREQUENCY ATTENUATOR

BACKGROUND OF THE INVENTION

This invention relates to a radio frequency attenuator and more particularly but not by way of limitation to an electrically controlled attenuator for electrically and magnetically controlling transmitted power in a waveguide.

Heretofore, radio frequency signals were attentuated by the use of inserting reflective objects inside the waveguide cavity and adjusting the position and or the amount of the insertion of the reflective objects to achieve a desired attenuation. In practice, this may consist of simply inserting different types of pins into the waveguide and adjusting the insertion depth of the pins with a micrometer. The operator performing the adjustments relies upon the measurement of the reflected or attenuated signal through the waveguide.

This method of attenuating a radio frequency signal is labor intensive and requires difficult work during the test to adjust the reflective pins to a desired depth. Also, vibration or shock may cause the pin to move in its position thereby greatly changing the amount of reflected or attenuated energy. The attenuation is also prone to error caused by small changes in pin position which occur as the pin is locked into position.

Further, modifications to the antenna or randome may necessitiate retuning of the system and the tuning stub or pins may be difficult to find and adjust.

In the following U.S. Patents, U.S. Pat. No. 2,532,157 to Evans, U.S. Pat. No. 2,784,378 to Yager, U.S. Pat. No. 3,798,207 to Reggia, U.S. Pat. No. 2,983,883 to Luhrs, U.S. Pat. No. 2,989,709 to Seidel et al, U.S. Pat. No. 3,063,029 to Hughes, U.S. Pat. No. 3,868,602 to Meddaugh, U.S. Pat. No. 4,092,617 to Titus, U.S. Pat. No. 4,188,594 to Bongianni and an 1949 Article to Miller various types of magnetically controlled microwave attenuators and solenoid controlled apparatus are descried for controlling signals which are both electrically and magnetically controlled. None of these prior art patents specifically describe the unique features and advantages of the subject radio frequency attenuator as described herein.

SUMMARY OF THE INVENTION

The subject invention provides an electrically and magnetically controlled attenuator for controlling the attenuation of radio frequency energy within a radio frequency system by both the use of a manual and autonomous feedback control system.

The radio frequency attenuator may be used to partially or completely block a waveguide channel for accurately controlling the amount of transmitted and reflected power.

The electrically controlled radio frequency attenuator for electrically and magnetically controlling the attenuation of the transmitted power in a waveguide includes a waveguide housing having an elongated cavity therethrough. A ferrous material such as a ferromagnetic fluid is disposed inside the cavity of the housing. An electrical coil is wrapped around the exterior of the housing with the leads connected to an electrical power supply for varying the electrical power to the coil. An electromagnetic field is set up within the waveguide housing with the ferromagentic fluid aligning itself parallel and coincident with the magnetic flux lines induced in the housing.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
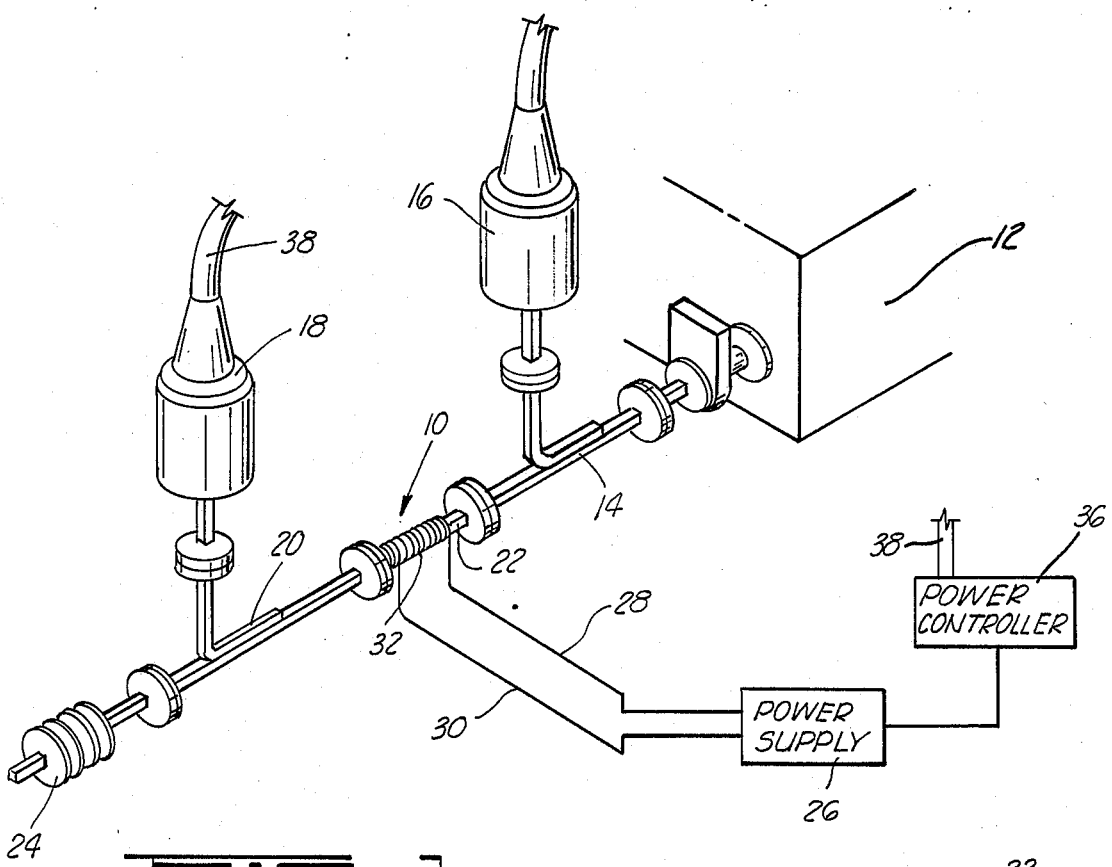
FIG. 1 illustrates a perspective view of the radio frequency attenuator connected to a transmitter, couplers and power meters.

In FIG. 1 a perspective view of the electrically controlled radio frequency attenuator is shown and designated by general reference numeral 10. The attenuator 10 is connected to a transmitter 12 via a first sampling coupler 14. The coupler 14 is connected to the incident power meter 16. The attenuator 10 output is also connected to a power meter 18 via a second sampling coupler 20. The sampling coupler 20 is also connected to a load 24. The transmitter 12 generates a radio frequency signal which is passed through a waveguide 22 which is part of the attenuator 10. The sampling coupler 14 is connected to the meter 16 which measures the amount of power delivered by the transmitter 12. The difference between the two coupler outputs is a measure of the attenuation provided by the radio frequency 10.

Figure 2:
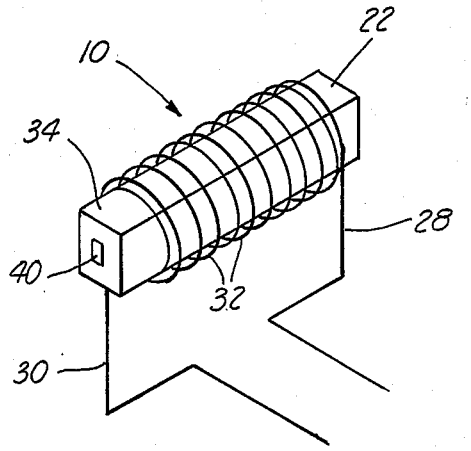
FIG. 2 illustrates a perspective view of the attenuator.
Figure 3:
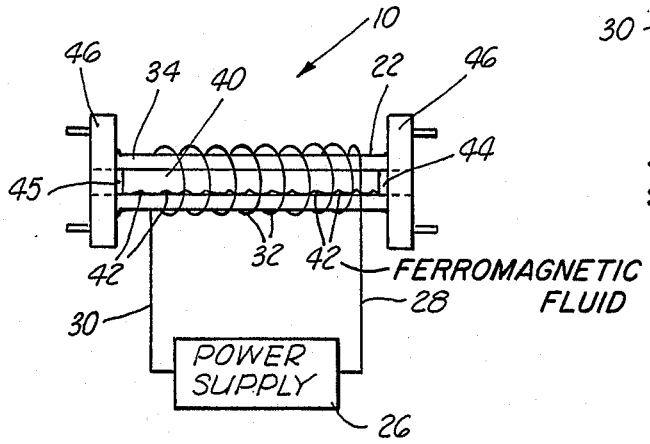
FIG. 3 illustrates a front view of the attenuator connected to a power supply.

The attenuator 10 is connected to a power supply 26 via leads 28 and 30 which are connected to a coil 32 wrapped around the exterior of a waveguide housing 34 which is part of the waveguide 22. The housing 34 is shown in FIGS. 2 and 3. The power supply 26 is controlled by a power controller 36 which receives transmitted power feedback indicated by lead 38. A typical current level from the power supply 26 is between 0 and 2 amps. The reflected power is typically 15 dB or more below the transmitted power. The transmitted power through the attenuator 10 varies over a 16 dB range as the coil current is varied from 0 to 2 amps. Typical test results show there is a major change in the transmitted power from the system shown in FIG. 1 whereas the reflected power is for most purposes negligible.

In FIGS. 2 and 3 the attenuator 10 is shown with the coil 32 wrapped around the housing 34 of the waveguide 22. The waveguide housing 34 includes an elongated waveguide channel cavity 40 extending along the length of the waveguide housing 34. As mentioned above the power supply 26 is connected to the coil 32 via the leads 28 and 30. Disposed inside the cavity 40 and shown in FIG. 3 is a ferrous material such as a ferromagnetic fluid 42 which is held therein by a pair of low loss material obstructions 44 and 45 mounted at the opposite ends of the waveguide housing 34.

By varying the current from the power supply 26 through the coil 32 an electromagnetic field is set up within the waveguide 22. Since the waveguide 22 is generally made up of a copper or silver material or some similar non-ferrous material, the field within the waveguide 22 in the absence of any externally applied field, is generally weak. When either a dry or liquid ferrous material is placed within the waveguide cavity 40 the ferromagnetic particles both enhance the magnetic field in the waveguide 22 and align themselves parallel and coincident with the flux lines.

In operation, the ferromagnetic fluid 42 adheres closely to the walls of the cavity 40 and when the current is applied to the attenuator 10, the ferromagnetic fluid 42 collects and partially or completely blocks or obscures the cavity 40. The percentages of the waveguide restricted by the ferromagnetic fluid 42 has a direct relationship to the amount of power transmitted through the attenuator. Changes in the transmitted power from the meter 18 are detected by the power controller 36 which in turn varies the current to the power supply 26 and then to the attenuator 10 for providing a preset value maintained by this type of feedback method.

It should be noted that the ferromagnetic fluid 42 shown in FIG. 3 can be replaced by a number of different types of ferrous material such as finely powdered soft ferrous oxide or any similar type of ferrous material. Further, the coil 32 could be replaced by permanent magnets that are moved by the use of micrometers or similar manual positioning devices. Also low loss material is used as obstructions 44 and 45 to constrain the movement of the ferromagnetic fluid 42 within the cavity 40. If permanent magnets are used in place of the coil 32, then small permanent magnets can be used to constrain the movement of the ferromagnetic fluid 42. Also shown in FIG. 3 are standard waveguide connectors or flanges 46 which are used to enable the attenuator 10 to be attached to other standard waveguides.

As mentioned in FIG. 1 the power supply 26 is connected to the power controller 36 where current and voltage control are provided. The amount of attenuation or the amount of power transmitted through the attenuator 10 can be modified by changing the voltage or current controlled by the power supply 26.

Changes may be made in the construction and arrangement of the parts or elements of the embodiments as described herein without departing from the spirit or scope of the invention defined in the following claims.

What is claimed is:

1. An electrically controlled radio frequency attenuator, the attenuator comprising:

a waveguide housing having an elongated cavity therethrough, the housing made of conductive non-ferrous material;

ferromagnetic particles in a fluid disposed inside the cavity of the housing and along the length of the cavity and held therein by low loss material obstructions mounted in opposite ends of the cavity;

an electrical coil wrapped around the exterior of the housing; and an electrical power supply connected to the coil for varying the electrical power to the coil, the powered coil causing a magnetic field to be set up within the waveguide housing with the ferromagnetic particles aligning themselves parallel and coincident with the magnetic flux lines induced in the housing, the particles fluid when energized, providing a physical obstruction along the length of the cavity.

2. The attenuator as described in claim 1 wherein the ferromagnetic particles in the fluid provided are in small amounts in relationship to the size of the cavity so the particles do not obstruct the waveguide in the absense of the magnetic field.

* * * * *